US005879529A

United States Patent [19]

Greaney et al.

[11] Patent Number: 5,879,529

[45] Date of Patent: Mar. 9, 1999

[54] METHOD FOR DECREASING THE CONRADSON CARBON CONTENT OF PETROLEUM FEEDSTREAMS

[75] Inventors: Mark Alan Greaney, Upper Black Eddy, Pa.; William Neergaard Olmstead, Murray Hill, N.J.

[73] Assignee: Exxon Research and Engineering Company, Florham Park, N.J.

[21] Appl. No.: 900,388

[22] Filed: Jul. 15, 1997

[51] Int. Cl.[6] ..... C25B 1/00

[52] U.S. Cl. ..... 205/696; 204/514; 204/559; 204/567

[58] Field of Search ..... 205/696; 204/514, 204/559, 567

[56] References Cited

U.S. PATENT DOCUMENTS 5,102,510 4/1992 Darian et al. ..... 204/59 R 5,514,252 5/1996 Kerby, Jr. et al. ..... 205/696

*Primary Examiner*—Arun S. Phasge

*Attorney, Agent, or Firm*—Linda M. Scuorzo

[57] ABSTRACT

The present invention provides for a method of decreasing the Conradson carbon content of metal containing petroleum streams by forming a mixture of the Conradson carbon containing petroleum fraction and an aqueous electrolysis medium containing an electron transfer agent, and passing an electric current through the mixture or optionally through the pretreated aqueous electrolysis medium at a voltage, sufficient to decrease the Concarbon content of the stream. The cathodic voltage is from 0 V to −3.0 V vs. SCE. The invention provides a method for enhancing the value of petroleum feeds that traditionally have limited use in refineries.

9 Claims, 1 Drawing Sheet

METHOD FOR DECREASING THE CONRADSON CARBON CONTENT OF PETROLEUM FEEDSTREAMS

FIELD OF THE INVENTION

The present invention relates to a method for electrochemically decreasing the Conradson carbon content of refinery feedstreams.

BACKGROUND OF THE INVENTION

Conradson carbon ("Concarbon") number is a measure of the characteristic tendency of a petroleum feedstream to form coke during processing. Feedstreams having a lower Concarbon number are more economically desirable as refinery feeds than feedstreams having a higher Concarbon number.

Electrochemical processes have been used for removal of halogenated organic compounds, e.g., polychlorinated biphenyls in one phase organic systems see e.g., U.S. Pat. No. 5,102,510 and for removal of water soluble metals from aqueous streams, see e.g., U.S. Pat. No. 3,457,152. Petroleum streams are typically not halogen containing. Decreasing the Conradson carbon content of petroleum streams is more difficult to achieve because the hydrocarbon species are not readily water soluble. U.S. Pat. No. 5,514,252 discloses a process for electrochemically decreasing the Conradson carbon content of petroleum streams, but there is a continuing need for effective treatment methods, particularly ones in which enhanced rates of treatment at higher current efficiencies and/or lower electrolyte concentrations are possible. Applicants' invention addresses this need.

SUMMARY OF THE INVENTION

Figure 1:
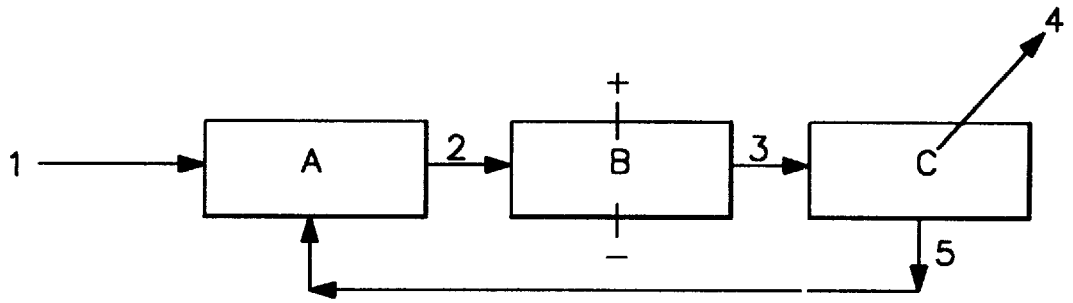
FIG. 1 illustrates an embodiment of the process for treating a concarbon containing petroleum stream and aqueous electrolysis medium containing the electron transfer agent by contacting both in the electrolyzer.

The present invention provides for a method for decreasing the Conradson carbon content of a petroleum stream. In one embodiment the process provides for a process for decreasing the Conradson carbon content of petroleum stream, comprising applying to an oil in water dispersion of a petroleum stream and an aqueous electrolysis medium containing at least one electron transfer agent and at least one electroconductive salt a sufficient electric current to produce a petroleum stream having a decreased Conradson carbon content. In another embodiment the process provides for contacting an aqueous electrolysis medium containing at least one electron transfer agent and at least one electronconductive salt with a sufficient electric current to produce a treated aqueous electrolysis medium containing a reduced electron transfer agent; and contacting the treated aqueous electrolysis medium with a Conradson carbon containing petroleum stream for a time sufficient to produce a petroleum stream having a decreased Conradson carbon content.

The Conradson carbon content of such streams is typically at least about 0.1 wt %.

The present invention may suitably comprise, consist or consist essentially of the described elements and may be practiced in the absence of an element not disclosed.

DETAILED DESCRIPTION OF THE INVENTION

The present invention provides for a method for decreasing the Conradson carbon ("Concarbon") number or content of a hydrocarbonaceous petroleum stream by subjecting a mixture or solution of a Conradson carbon containing petroleum stream (also referred to herein as a fraction or feed) and water and at least one electroconductive, preferentially water soluble salt, and at least one preferentially water soluble or solubilizable electron transfer agent to an electric current for a time and at conditions sufficient to decrease the Conradson carbon content of the stream (i.e., to produce a treated petroleum fraction having decreased Conradson carbon content). Conradson carbon content decrease occurs from the petroleum (i.e., oil) phase. The contacting is carried out under conditions to result in passing of an electric current therethrough.

Conradson carbon number correlates with the coke residue forming propensity of petroleum streams. Petroleum streams having a high coke make typically have a deleterious effect on a number of petroleum refinery processes, such as fluid catalytic cracking, hydrotreating, coking, visbreaking, deasphalting and pipestill operations. In addition, coke is currently a low value refinery product, and thus generation of large quantities is not economically desirable. The higher the Concarbon number the greater the number or size of the refinery units typically needed to process the resulting residue.

A wide variety of petroleum streams, including distillates thereof may be treated according to the process of the present invention to produce petroleum hydrocarbon fractions having decreased Conradson carbon number or content. Suitable starting feedstocks are hydrocarbonaceous petroleum streams or fractions having a Conradson carbon content or number typically of at least about 0.1% by weight, and usually at least about 5% by weight. The process is applicable to distillates and other Conradson carbon containing product feeds resulting from various refinery processes, but is particularly effective when employed to treat heavy hydrocarbon feeds, e.g., those containing residual oils. Preferably, therefore, the process of the present invention is utilized for the treatment of whole or topped crude oils and residua having a Conradson carbon content. These include heavy oils, such as atmospheric residuum (boiling above about 650° F. 343° C.) and vacuum residuum (boiling above about 1050° F. 566° C). heavy crudes, processed resids (bottoms), e.g., catalytic cracker bottoms, tars, steam cracker tars, distillation residues, deasphalted oils and resins and coker oils. Virgin crude oils obtained from any area of the world such as the Middle East as well as heavy gas oils, shale oils, tar sands or syncrude derived from tar sands, distillation residues, coal oils, asphaltenes and other heavy petroleum fractions and distillates thereof can be treated by the process of this invention.

Petroleum streams are complex mixtures of many different types of reactive and unreactive species. As such the ability to successfully treat particular components of petroleum streams or fractions is not readily predictable from the reactivity of and success in treating pure components.

A benefit of the process of the present invention is in its ability to decrease Concarbon content contained in typically non-water extractable fractions, at lower concentrations of salts and at higher current efficiencies than in current processes.

The petroleum feed to be treated preferably should be in a liquid or fluid state at process conditions. This may be accomplished by heating the material or by treatment with a suitable solvent as needed. This assists in maintaining the mixture of the petroleum stream and aqueous electrolysis medium containing the electron transfer agent and salt in a fluid form to allow passage of an electric current. Current densities of 1 $mA/cm^2$ of cathode surface or greater area are suitable.

Preferably the oil droplets should be of sufficient size to enable the Conradson carbon containing components to achieve intimate contact with the electron transfer agent in the aqueous electrolysis medium. Droplet size particles of about 0.1 micron to 1.0 mm, for example are suitable. Desirably the process should be carried out for a time and at conditions within the ranges disclosed sufficient to achieve a decrease, preferably a maximum decrease, in Conradson carbon content or number of the petroleum stream. Contacting is typically accomplished by intimate mixing of the Concarbon-containing petroleum stream and the aqueous electrolysis medium (which contains the electrolyte salt and either the pretreated, i.e., reduced electron transfer agent, or the untreated electron transfer agent, depending on the embodiment of the invention) to form a mixture or oil-in-water dispersion (i.e., with the aqueous phase containing the electron transfer agent and electrolyte salt as the continuous phase), for example using a stirred batch reactor or turbulence promoters in flowing cells.

Unexpectedly, introducing into the system a relatively small quantity of one or more compounds which are effective to increase the rate and/or efficiency of electron transfer can potentially increase the rate of demetallation. These species or compounds are referred to herein as electron transfer agents. These agents undergo reversible electrochemical reductionoxidation (i.e., are redox active).

The electrochemical cell is typically equipped with at least two oppositely charged electrodes including cathodes (working electrodes) and anodes (counter electrodes) with electrolyte in the system to complete the cell circuitry for operation of the cell. For example, a plurality of working electrodes and counterelectrodes placed in a pack may be employed. The electrochemical cell can optionally include a reference electrode placed between the working and counter electrodes to monitor desired working electrode voltages during the electrochemical demetallation reaction.

Electrode materials useful in accordance with the present process should be resistant to degradation by and dissolution in the materials and salts employed during the electrochemical process. Such materials should also be stable under the electrical field imposed thereon. Suitable materials which can be used as working electrodes are those which will support the electrochemical decrease in Concarbon number and which are preferably stable and inexpensive include lead, cadmium, zinc, tin, mercury and alloys thereof, and carbon, and other materials suitable for treatment as described herein. Included as suitable electrodes are three-dimensional electrodes, such as carbon or metallic foams. Suitable materials which can be used as counterelectrodes should be resistant to degradation and corrosion in the presence of the products produced in the electrochemical process. Other conventional electrodes known to those skilled in the art which are stable in aqueous solutions containing an electrolyte salt and electron transfer agent of the types used herein may be used.

As set forth above, the present inventive process is carried out in an electrochemical cell containing an aqueous electrolysis medium that is capable of conducting electric current and supporting the electrochemical treatment herein in the presence of an electroconductive salt and an electron transfer compound. The aqueous electrolysis medium is the continuous phase in the present electrochemical process and is contacted with the Concarbon containing petroleum stream as the dispersed phase in the aqueous electrolysis medium.

The salt and electron transfer agent should be sufficiently soluble or solubilizable in the aqueous electrolysis medium to provide sufficient conductivity and reaction rates.

Materials useful as electron transfer agents are capable of undergoing reversible electrochemical reduction-oxidation during treatment of the petroleum stream, and are sufficiently soluble or solubilizable in the aqueous electrolysis medium to provide the desired reaction rate. Some representative examples of compounds include organic, organometallic and inorganic species.

The electron transfer agents can be any water soluble or water solubilizable chemical species which shows reversible electrochemical redox behavior within the potential range of 0 to −3.0 V vs. SCE. One normally skilled in the art would recognize that this is suitably determined for a material by measuring the species' cyclic voltamograms in an aqueous electrolyte and determining if the species exhibits reversible electrochemical redox in this potential range. In the process of the present invention, the electron accepted by the electron transfer agent would not be donated to the anode during electrolysis, but rather to species to be treated within the petroleum stream. Chemical species which could be considered for this process include both organic species and metal complexes which undergo reversible redox as described above. For example, in the organic category are species such as quinones, anthroquinones, benzoquinones, naphthaquinones, xanthones, phthallic acids, sulfonates, tosylates, carboxylates and benzophenones with suitable substituents to assist in water solubility and to tune the redox properties to the desired potential range. Many types of metal complexes could be considered for this process, such as trisbipyridyl, trisphenanthroline and dithiocarbamate complexes of transition metals. Derivatization of ligands to increase water solubility and to affect redox potentials could be conducted by one normally skilled in the art. A range of potential electron transfer agents are possible, limited only by their water solubility or solubilizability and their reversible redox behavior in the desired potential range.

The ratio of electron transfer agent to salt can be chosen by one skilled in the art to influence both the rate and efficiency of decrease in Concarbon content depending upon the particular materials used, their concentrations and processing conditions.

The electrolyte salt in the aqueous electrolysis medium is desirably a salt that dissolves or dissociates in water to produce electrically conducting ions, but that does not undergo redox in the range of applied potentials used. Suitable organic electrolytes include quaternary carbyl and hydrocarbyl onium salts, e.g., alkylammonium salts. Inorganic electrolytes include, e.g., NaOH, KOH and sodium phosphates. Mixtures thereof also may be used. Suitable onium ions include mono-and bis-phosphonium, sulfonium and ammonium. Carbyl and hydrocarbyl moieties are preferably alkyl. Quaternary alkylammonium ions include tetramethylammonium, tetraethylammonium and tetrabutylammonium. Optionally, additives known in the art to enhance performance of the electrodes or the system may be added such as surfactants, detergents, emulsifing agents and anodic depolarizing agents.

Typically a concentration of salt 1–50 wt % in the aqueous electrolysis medium, preferably 5–25 wt % is suitable, with the use of lower amounts of salt being anticipated in the presence of the electron transfer agent.

The pH of the solution should be chosen with regard to the particular electron transfer agent and salt used and may also vary with the feed to be treated.

Reaction temperatures will vary with the particular petroleum stream due to its viscosity, and the type of electrolyte and its pH. However, temperatures may suitably range from about ambient to about 700° F. (371° C.), preferably from 100° F. (38° C.) to 300° F. (149° C.), and pressures of from 0 atm (0 kPa) to 210 atm (21,200 kPa), preferably 1 atm (101 kPa) to 3 atm (303 kPa). Within the process conditions disclosed a liquid or fluid phase or medium should be maintained.

Desirably the process should be carried out for a time and at conditions within the ranges disclosed sufficient to achieve a decrease, preferably a maximum decrease, in the Conradson carbon number of the petroleum stream.

A benefit to the present invention is that the process may be operated under ambient temperature and atmospheric pressure, although higher temperature and pressures also may be used as needed. Its most basic form is carried out in an electrochemical cell, by electrolytic means, i.e. in a nonelectrostatic mode, as passage of current is required (e.g., relatively low voltagehigh current). The cell may be either divided or undivided. Such systems include stirred batch or flow through reactors. The foregoing may be purchased commercially or made using technology known in the art. The cathodic voltage is in the range 0 to −3.0 V versus Saturated Calomel Electrode (SCE), preferably −1.0 to −2.5 V based on the characteristics of the particular petroleum fraction and the electron transfer agent. While direct current is typically used, electrode performance may be enhanced using alternating current, or other voltagecurrent waveforms.

One embodiment of the electrochemical process of the present invention (represented in FIG. 1) is carried out in an electrochemical cell on a Concarbon containing petroleum stream, in contact with an aqueous electrolysis medium containing at least one electrolyte salt and electron transfer agent preferentially soluble in the aqueous medium in which a voltage is applied to oppositely charged cathodes and anodes in the electrochemical cell. After treatment the upgraded (Concarbon content-decreased) petroleum stream is separated from the aqueous electrolysis medium before recycle of the aqueous electrolysis medium to treat additional Conradson carbon-containing petroleum feed. Thus, in the first embodiment the Concarbon-containing petroleum stream and aqueous electrolysis medium containing the electrolyte salt and electron transfer agent are combined and subjected to application of a suitable cathodic voltage to produce a decrease in the Conradson carbon content.

In another embodiment of the process of the present invention the aqueous electrolysis medium (containing the electron transfer agent) is subjected to separate electrochemical treatment in an electrochemical cell in which a voltage is applied to oppositely charged electrodes to produce a reduced electron transfer agent (i.e., in an electrochemical reduction step). The electrochemically pretreated aqueous electrolysis medium containing the electrolyte salt and reduced electron transfer agent is then contacted with the Concarbon-containing petroleum stream to form an oil-in-water dispersion for a time and at conditions sufficient to produce a treated petroleum stream having a decreased Concarbon content. The upgraded (i.e., Concarbon-decreased) petroleum stream can be separated from the aqueous electrolysis medium containing the electrolyte salt and oxidized electron transfer agent and the aqueous electrolysis medium recycled to the electrochemical treatment step. Beneficially in this embodiment the petroleum stream does not contact the anode and cathode (i.e., Concarbon treatment occurs separately from the electrochemical treatment step).

In the Figures, the lettered boxes designate process steps and the numbered arrows designate process streams.

FIG. 1 represents one embodiment of the process of the present invention. In FIG. 1 the Conradson carbon-containing petroleum stream (1) and the aqueous electrolysis medium containing the electron transfer agent and salt (5) are contacted in Contactor, A. This contacting may be achieved by such devices as in-line static mixers, a mixing tank, a sonication mixer, etc. The resultant oil-in-water dispersion (2) of fine oil droplets dispersed in the aqueous electrolysis medium is then passed to electrolyzer, B, in which the electrochemical treatment conducted. A variety of devices can be used, ranging from a single continuously stirred tank (CSTR) type electrochemical cell to a cascade of plug flow electrolyzers. Recirculation of stream (3) through step B (not shown in Figure) may be required to achieve desired levels of Concarbon number reduction and would be considered a process optimization. The electrolyzer, B, consists of at least one cathode and anode arranged appropriately to achieve passage of electric current at suitable cathodic potentials to result in decrease in Concarbon content of the petroleum stream. Treated stream (3) exiting electrolyzer, B, is an oil-in-water dispersion in which the oil component has a decreased Concarbon content. The stream (3) is passed to at least one separator, C, in which the oil and aqueous electrolyte phases are separated. This step could be achieved in a variety of ways: with a large holding tank, a gravity settler/coaleser, an electrostatic coalescer, etc. The Concarbon content-decreased petroleum stream (4) may be passed on for further processing in the refinery. The aqueous electrolyte stream (5) containing the salt and electron transfer reagent is recycled back to contactor, A, for mixing with additional Concarbon containing petroleum stream. Addition of a make-up stream of fresh electrolyte and electron transfer agent to maintain steady-state performance would be considered a process optimization.

Figure 2:
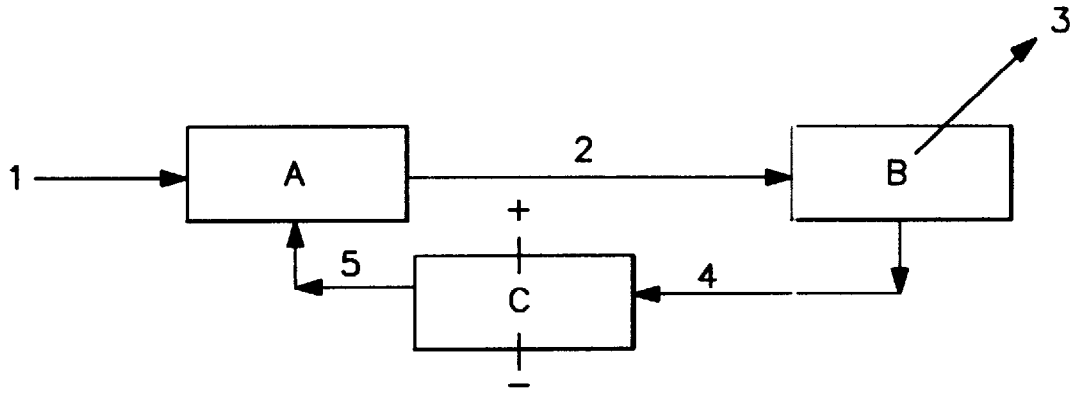
FIG. 2 illustrates an embodiment of the process in which the electron transfer agent is pretreated in the electrolyzer before contacting the petroleum stream.

FIG. 2 represents a second embodiment of the process of the present invention. The feed to the process is the same as in FIG. 1, i.e., a Concarbon-containing petroleum stream (1). However, in Contactor, A, the aqueous electrolysis medium containing the salt and electron transfer agent (4) has been electrochemically pretreated in the electrolyzer, C. The aqueous electrolysis medium containing salt and electrochemically-reduced electron transfer agent exits electrolyzer, C, as electrochemically treated stream, (5). Treatment in the electrolyzer, C, produces an electron transfer agent that is reduced, that is, has accepted electrons at the cathode (and can transfer these electrons to acceptor molecules in the petroleum stream upon mixing). In FIG. 1 above, by contrast, the electron transfer agent is first mixed with the petroleum stream and then both the aqueous electrolysis medium and petroleum phases are subjected to electrochemical treatment. In the alternative embodiment in FIG. 2, only the aqueous electrolyte stream is subjected to direct electrochemical reduction in electrolyzer, C. By eliminating passage of petroleum stream through electrolyzer C, improvement in electrode lifetime and elimination of electrode fouling are anticipated. The potentially smaller size of the aqueous electrolysis medium stream (4) relative to the oil-in-water dispersion stream (2) could also offer opportunities for more compact and less costly electrolyzer C. In FIG. 2, stream (2) is an oil-in-water dispersion in which the petroleum stream has undergone indirect reduction and Concarbon decrease by contact with the pre-reduced electron transfer agent. In Separator B (equivalent to C in FIG. 1) the treated petroleum stream (3) is separated from the aqueous electrolysis medium stream (4) which is recycled through the electrolyzer C. In stream (4) the electron transfer agent is in its oxidized form and can again accept electrons by passage through electrolyzer, C. In stream (5) the electron transfer agent is in its reduced form and can donate electrons to the petroleum stream (1) in contactor A.

What is claimed is:

1. A process for decreasing the Conradson carbon content of a petroleum stream, comprising:

applying to an oil in water dispersion of a Conradson carbon containing petroleum stream and an aqueous electrolysis medium containing at least one electron transfer agent and at least one redox-stable electroconducfive salt a sufficient electric current to produce a petroleum stream having a decreased Conradson carbon content.

2. The process of claim 1 wherein the electron transfer agent is selected from organic species and metal complexes capable of undergoing reversible electrochemical reduction-oxidation.

3. The process of claim 2 wherein the electric current is at a cathodic voltage of 0 to −3.0 V vs. SCE.

4. A process for decreasing the Conradson carbon content of a petroleum stream, comprising:

(a) contacting an aqueous electrolysis medium containing at least one electron transfer agent and at least one electronconductive salt with a sufficient electrical current to produce a treated aqueous electrolysis medium containing a reduced electron transfer agent;

(b) contacting the treated aqueous electrolysis medium with a Conradson carbon containing petroleum stream for a time sufficient to produce a petroleum stream having a decreased Conradson carbon content.

5. The process of claim 4 wherein the electric current is at a cathodic voltage of from 0 to −3.0 V vs. SCE.

6. The process of claim 4, wherein the contacting of step (b) produces an oil-in-water dispersion of the Conradson carbon containing petroleum stream in the aqueous electrolysis medium.

7. The process of claim 4, wherein the contacting of step (b) results in the production of oxidized electron transfer agent in the aqueous electrolysis medium.

8. The process of claim 7, further comprising recycling the aqueous electrolysis medium to treat an additional Conradson carbon containing petroleum stream.

9. The process of claim 4, further comprising recovering and treating the aqueous electrolysis medium containing the electron transfer agent and electroconductive salt to regenerate the reduced electron transfer agent.

* * * * *